US010960415B1

(12) United States Patent
Amato et al.

(10) Patent No.: US 10,960,415 B1
(45) Date of Patent: Mar. 30, 2021

(54) SPRAY NOZZLE AND METHOD

(71) Applicant: Bete Fog Nozzle, Inc., Greenfield, MA (US)

(72) Inventors: Eric R. Amato, Orange, MA (US); Ronald W. Rzeszutek, Easthampton, MA (US)

(73) Assignee: Bete Fog Nozzle, Inc., Greenfield, MA (US)

( * ) Notice: Subject to any disclaimer, the term of this patent is extended or adjusted under 35 U.S.C. 154(b) by 186 days.

(21) Appl. No.: 15/851,233

(22) Filed: Dec. 21, 2017

Related U.S. Application Data

(60) Provisional application No. 62/438,751, filed on Dec. 23, 2016.

(51) Int. Cl.

| | |
|---|---|
| ***B05B 1/26*** | (2006.01) |
| ***B05B 13/06*** | (2006.01) |
| ***B05B 1/18*** | (2006.01) |
| ***B05B 15/52*** | (2018.01) |
| ***B08B 9/093*** | (2006.01) |
| *B05B 3/06* | (2006.01) |

(52) U.S. Cl.
CPC ..... *B05B 1/185* (2013.01); *B05B 1/262* (2013.01); *B05B 15/52* (2018.02); *B08B 9/0936* (2013.01); *B05B 3/06* (2013.01); *B05B 13/0636* (2013.01)

(58) Field of Classification Search
CPC ..... B05B 1/14; B05B 1/20; B05B 1/26–267; B05B 13/0627; B05B 1/185; B08B 3/02; B08B 9/0813; B08B 9/093–0936
USPC ..... 169/37–41, 90; 239/498, 518, 520–524
See application file for complete search history.

(56) References Cited

U.S. PATENT DOCUMENTS 1,373,372 A * 3/1921 Waite ..... B05B 3/02 239/222.13
2,343,305 A * 3/1944 Larter ..... B05B 1/26 239/544

(Continued)

FOREIGN PATENT DOCUMENTS

FR 2164022 A5 * 7/1973 ..... F28F 25/08

OTHER PUBLICATIONS

Globe Fire Sprinkler Corporation, Brochure, print out of https://s3.amazonaws.com/s3.supplyhouse.com/product_files/561528602-brochure.pdf, dated May 2011, 2 pages.

(Continued)

*Primary Examiner* — Cody J Lieuwen
(74) *Attorney, Agent, or Firm* — McCarter & English, LLP

(57) ABSTRACT

A spray nozzle, which in some embodiments has a body and a deflector, the body having a fluid passageway and an outer wall including a plurality of fluid-flow orifices therethrough in fluid communication with the fluid passageway and spaced at least partly circumferentially around the outer wall, where the deflector is disposed at least partly circumferentially about and radially outwardly of the body in fluid communication with the plurality of fluid-flow orifices, and the body includes slots and fingers spaced at least partly circumferentially about the deflector. Some embodiments include a second deflector. In some embodiments, each finger and slot has a configuration that defines, at least in part, a flow trajectory, and the flow trajectory defined, at least in part, by one finger or slot is different from the flow trajectory defined by another finger or slot.

44 Claims, 7 Drawing Sheets

(56) References Cited

U.S. PATENT DOCUMENTS

| | | | | |
|---|---|---|---|---|
| 3,104,672 | A * | 9/1963 | Holdren | B08B 9/093 134/168 R |
| 4,697,292 | A * | 10/1987 | Lavalley | B01D 33/60 138/172 |
| 5,028,007 | A * | 7/1991 | Wokal | B05B 1/202 239/518 |
| 5,687,914 | A | 11/1997 | Bosio et al. | |
| 8,925,641 | B1 | 1/2015 | Fischer | |
| 2011/0061879 | A1* | 3/2011 | Lakkonen | B05B 1/267 169/37 |
| 2012/0292403 | A1 | 11/2012 | Hunnicutt et al. | |
| 2013/0043321 | A1 | 2/2013 | Thomas et al. | |
| 2013/0333903 | A1 | 12/2013 | Pounder et al. | |
| 2015/0083827 | A1 | 3/2015 | Townsend et al. | |

OTHER PUBLICATIONS

Digital image of sprinkler head printed from https://firesprinklercollection.wordpress.com/2013/09/07/45/, dated Sep. 7, 2013, 1 page.

International Search Report and Written Opinion for Application No. PCT/US2018/061173, dated Jan. 24, 2019, 11 pages.

* cited by examiner

SPRAY NOZZLE AND METHOD

CROSS-REFERENCE TO RELATED APPLICATIONS

This application claims the benefit under 35 U.S.C. § 119(e) to U.S. Provisional Application No. 62/438,751 entitled "Spray Nozzle and Method" filed Dec. 23, 2016, which is incorporated by reference in its entirety herein.

FIELD OF THE DISCLOSURE

The present disclosure generally relates to spray nozzles and to related methods, and more particularly, to spray nozzles for spraying an interior of a tank or other vessel (which may or may not be an enclosed), and to related methods.

BACKGROUND INFORMATION

Tank washing (also sometimes referred to as Clean-In-Place (CIP)) spray nozzles play a vital role in washing or otherwise cleaning interior surfaces of tanks and closed vessels after use from applications including, but not limited to, storage, mixing and/or processing. A spray nozzle may be installed in a vessel permanently or only inserted for the cleaning process.

One type of tank washing nozzle is a static spray ball, an example of which is shown in FIG. 1. It consists of a thin-walled metal alloy sphere, having many small orifices drilled in various orientations to produce a spray pattern.

Spiral or "pigtail" spray nozzles consist of a helical geometry where each turn of the spiral sheers the water at a different conical spray angle so as to produce a spray pattern.

Another type of nozzle is a "nozzle manifold," which is an assembly of a plurality of traditional full cone spray nozzles on a common manifold with each spray nozzle being in a different orientation to achieve a spray pattern.

Reaction-driven rotating nozzles employ a slotted spherical head or other geometry on a free spinning shaft that rotates due to reaction force of the spray. Such nozzles are capable of quickly providing spray coverage.

High impact geared rotating spray nozzle types are geared machines driven by either liquid flow through the assembly or by an external motor. They typically employ two or more high impact straight jet nozzles that rotate in an indexing geared pattern.

SUMMARY OF THE INVENTION

It is an object of at least some embodiments of the present invention to address one or more deficiencies of known spray nozzles.

Selection of the most appropriate spray nozzle for washing or otherwise cleaning a given vessel may depend on several factors such a degree and type of soiling of the vessel walls, available water supply conditions, physical size requirements, material compatibility and free passage diameter.

In many industries, such as winemaking, brewing and food processing, a cleaning solution is often recirculated, which means that leftover debris in the vessel could potentially be pumped into the spray nozzle. In the winemaking industry, for example, this debris may consist of grape stems, seeds, and skins. If this occurs, it is critical (or at least highly desirable) that the nozzle allow the debris to pass through the nozzle without causing fouling or clogging of the nozzle orifice(s) or malfunction of moving parts as the case may be with rotating wash nozzles. In addition, these industries often require that spray nozzles be manufactured with a smooth surface finish and designed to be crevice-free and self-draining for sanitary reasons.

In a static spray ball nozzle such as shown in FIG. 1, the use of small orifices make the nozzle prone to fouling or clogging when debris is present in the water or cleaning solution. An example of a static spray ball is shown in FIG. 1.

Spiral or "pigtail" spray nozzles fit through a small vessel opening. However, due to their spiral geometry, these nozzles are physically limited to a 270 degree spray angle, which means that there is no available spray coverage of the downpipe or vessel ceiling.

Nozzle manifold assemblies are typically very large and bulky, requiring an exceptionally large vessel opening. In addition, the manifolds often result in areas without spray coverage unless the assembly is designed with excessive overlap between spray patterns from adjacent spray nozzles.

In reaction-driven rotating nozzles, the sprayed liquid is relied upon to provide flushing and lubrication of the nozzle bearings or bearing surfaces. As such, proper filtration of the cleaning solution is critical to avoid premature bearing wear or contamination, in which case the nozzle head will cease to spin, severely reducing the washing effectiveness of the nozzle.

High impact geared rotating nozzles, like their free-spinning counterparts, are typically self-cleaning and self-lubricating. Due to the gears and other complex internal mechanisms, they require proper filtration of the cleaning solution. The presence of solids or the eventual wear of moving parts could, for example, potentially bind a gear, causing a complete lack of coverage on the vessel walls except for the impact area of the narrow jets. The small cleaning path of each jet requires a long cycle time for complete coverage of the vessel walls.

In accordance with at least some embodiments of the invention, a spray nozzle includes a body having a proximal end and a distal end and defining a fluid passageway to flow fluid in a direction from the proximal end toward the distal end. The body has an outer wall disposed circumferentially about an axis, the outer wall defining a first plurality of fluid-flow orifices and a second plurality of fluid-flow orifices that are in fluid communication with the fluid passageway, spaced circumferentially around the outer wall and extend therethrough.

In accordance with at least some embodiments, the spray nozzle further includes a first deflector disposed circumferentially about the axis, extending radially outwardly of the body and coupled thereto, the first deflector being in fluid communication with the first plurality of fluid-flow orifices and defining a first plurality of slots that are spaced circumferentially about the first deflector and extend toward the proximal end of the body, the first deflector further defining a first plurality of fingers or members that are spaced circumferentially about the first deflector and extend outwardly and toward the proximal end of the body, wherein circumferentially successive ones of the first plurality of slots are spaced apart from one another at least in part by a respective one of the first plurality of fingers.

In accordance with at least some embodiments, the spray nozzle further includes a second deflector disposed circumferentially about the axis, radially outwardly of the body and coupled thereto, the second deflector being in fluid communication with the second plurality of fluid-flow orifices and defining a second plurality of slots that are spaced circumferentially about the second deflector and extend toward the distal end of the body, the second deflector further defining a second plurality of fingers or members that are spaced circumferentially about the second deflector and extend outwardly toward the distal end of the body, wherein circumferentially successive ones of the second plurality of slots are spaced apart from one another at least in part by a respective one of the second plurality of fingers.

In accordance with at least some embodiments, the first plurality of fluid-flow orifices is disposed in a first plane and the second plurality of fluid-flow orifices is disposed in a second plane different from the first plane.

In accordance with at least some embodiments, the first plurality of fluid-flow orifices are circumferentially offset from the second plurality of fluid-flow orifices In accordance with at least some embodiments, the first deflector is a first deflector cup and the second deflector is a second deflector cup.

In accordance with at least some embodiments, configurations of the first plurality of slots vary from slot to slot, configurations of the first plurality of fingers vary from finger to finger, configurations of the second plurality of slots vary from slot to slot, and configurations of the second plurality of fingers vary from finger to finger.

In accordance with at least some embodiments, configurations of the first plurality of slots vary from slot to slot and define a repeating pattern on the first deflector, configurations of the first plurality of fingers vary from finger to finger and define a repeating pattern on the first deflector, configurations of the second plurality of slots vary from slot to slot and define a repeating pattern on the second deflector, and configurations of the second plurality of fingers vary from finger to finger and define a repeating pattern on the second deflector.

In accordance with at least some embodiments, the spray nozzle produces or substantially produces a 360 degree omni-directional spray pattern. In accordance with at least some other embodiments, one of the deflectors produces or substantially produces a 90 degree spray pattern so that the nozzle produces or substantially produces a 270 degree spray pattern.

In accordance with at least some embodiments, the spray nozzle is self-draining.

In accordance with at least some embodiments, the nozzle may be a static (non-rotating) 360 degree tank wash nozzle with a free passage diameter that is, on average, at least two times larger than that of a comparable spray ball. The nozzle may have a discrete number of large-diameter orifices (relative to the orifices of a spray ball of comparative flow rate and rated washing diameter) to create heavy straight jets that then disperse using specially designed deflection cups. These deflection cups may be slotted to help break the jets into a desired spray pattern, e.g., uniform 360 degree omni-directional spray pattern.

In accordance with at least some embodiments, the orifices are larger than those of a static spray ball of comparable flow rate and rated washing diameter and the deflection cups are constantly self-flushing with no geometry to capture or catch debris. Such nozzle is substantially more resistant to clogging than a static spray ball of comparable flow rate and rated washing diameter.

In accordance with at least some embodiments, the nozzle has no moving parts, making it more reliable and maintenance-free than a comparably sized rotating nozzle.

In accordance with at least some embodiments, the design is manufacturable in a way that maintains good surface finish, crevice-free joints, and self-draining function to meet sanitary requirements for certain industries and applications. In accordance with at least some embodiments, the body and at least one deflector define a crevice-free junction or joint.

In accordance with at least some embodiments, a uniform or nearly uniform 360 degree omni-directional spray pattern can be achieved. This accomplishes a high degree if not complete coverage of the vessel walls in a much shorter time than jet nozzle designs.

In some embodiments, a spray pattern of less than 360 degree may be suitable or otherwise suffice.

In some embodiments, a 180 degree or substantially 180 degree spray pattern may be suitable or otherwise suffice.

Thus, in accordance with some embodiments, the spray nozzle need not include a second deflector.

In accordance with some embodiments, the spray nozzle produces or substantially produces a 180 degree spray pattern that is omni-directional within such spray pattern (sometimes referred to herein as a 180 degree omni-directional spray pattern).

In accordance with at least some embodiments, a uniform or nearly uniform 180 degree omni-directional spray pattern can be achieved.

In yet other embodiments, a spray pattern of a desired coverage is provided, i.e., from 0 degrees to 360 degrees.

In accordance with at least some embodiments of the invention, a spray nozzle includes a body defining a fluid passageway to flow fluid in a direction, the body having an outer wall disposed at least partly circumferentially about an axis, the outer wall defining a plurality of fluid-flow orifices that are in fluid communication with the fluid passageway, spaced at least partly circumferentially around the outer wall and extending therethrough, each one of the plurality of fluid-flow orifices defining a flow direction.

In accordance with at least some embodiments, the spray nozzle further includes a deflector disposed at least partly circumferentially about the axis, outwardly of the body and coupled thereto, the deflector being in fluid communication with the plurality of fluid-flow orifices and defining a concave shape, at least in part, a plurality of slots that are spaced at least partly circumferentially about the deflector and extend outwardly relative to the body, and a plurality of fingers that are spaced at least partly circumferentially about the deflector and extend outwardly relative to the body, each one of the plurality of fingers and the plurality of slots being in fluid communication with at least one of the plurality of fluid-flow orifices and defining an angle relative to the flow direction defined by said at least one of the plurality of fluid-flow orifices in fluid communication therewith, wherein circumferentially successive ones of the plurality of slots are spaced apart from one another at least in part by a respective one of the plurality of fingers. In yet other embodiments, the spray nozzle has more than one deflector.

In accordance with at least some embodiments, (i) the angle defined by one of the plurality of fingers may be different from the angle defined by another of the plurality of fingers and/or (ii) the angle defined by one of the plurality of slots may be different from the angle defined by another of the plurality of slots.

In accordance with at least some embodiments, each of the plurality of fingers and/or slots may have a configuration that defines, at least in part, a flow trajectory for the fluid. The flow trajectory defined, at least in part, by the configuration of at least one of the plurality of fingers may be different than the flow trajectory defined, at least in part, by the configuration of at least one other of the plurality of fingers. The flow trajectory defined, at least in part, by the configuration of at least one of the plurality of slots may be different than the flow trajectory defined, at least in part, by the configuration of at least one other of the plurality of slots.

Other embodiments are directed to methods of dispensing fluid from a nozzle. In some embodiments, the method includes (i) flowing fluid outwardly from a nozzle body in fluid communication with a source of said fluid and over at least one deflector in an at least partly radial direction relative to the nozzle body, wherein the at least one deflector is disposed at least partly circumferentially about the nozzle body and defines a plurality of slots spaced at least partly circumferentially about the at least one deflector and extending outwardly from the nozzle body and toward an end of the body and a plurality of fingers spaced at least partly circumferentially about the at least one deflector and extending outwardly relative to the body and toward the end of the body, wherein circumferentially successive ones of the plurality of slots are spaced apart from one another at least in part by a respective one of the plurality of fingers, and wherein each one of the plurality of fingers and the plurality of slots defines an angle relative to nozzle body and (a) said angle defined by one of the plurality of fingers is different than said angle defined by another of the plurality of fingers and/or (b) said angle defined by one of the plurality of slots is different than said angle defined by another of the plurality of slots; and (ii) flowing the fluid off of the at least one deflector at a plurality of said angles defined by said fingers and said slots.

In some such embodiments, the method includes flowing the fluid off of the at least one deflector in an approximately 180 degree spray pattern. In some embodiments, step (ii) includes flowing the fluid off of the at least one deflector in a substantially circumstantially symmetrical pattern about the nozzle body. In other embodiments, step (ii) includes flowing the fluid off of the at least one deflector in a circumstantially asymmetrical pattern about the nozzle body. In some embodiments, the method includes preventing clogging of the slots by debris in the fluid passing therethrough.

In some embodiments, the method includes (i) flowing fluid outwardly from a nozzle body in fluid communication with a source of said fluid and over first and second deflectors in an at least partly radial direction relative to the nozzle body, the first deflector being disposed at least partly circumferentially about the nozzle body and defining a plurality of slots spaced at least partly circumferentially about the first deflector and extending outwardly and toward a first end of the body and a plurality of fingers spaced at least partly circumferentially about the first deflector and extending outwardly and toward the first end of the body, wherein circumferentially successive ones of the plurality of slots are spaced apart from one another at least in part by a respective one of the plurality of fingers, and the second deflector being disposed at least partly circumferentially about the nozzle body and defining a plurality of slots spaced at least partly circumferentially about the second deflector and extending outwardly and toward a second end of the body opposite the first end, and a plurality of fingers spaced at least partly circumferentially about the second deflector and extending outwardly and toward the second end of the body, wherein circumferentially successive ones of the plurality of slots of the second deflector are spaced apart from one another at least in part by a respective one of the plurality of fingers of the second deflector; and (ii) flowing the fluid off of the first and second deflectors by flowing the fluid through the slots of the first and second deflectors and off ends of the fingers of the first and second deflectors.

Some such embodiments include flowing a portion of said fluid over the first deflector at a first location of the nozzle body and flowing a portion of said fluid over the second deflector at a second location of the nozzle body. In some embodiments, step (ii) includes flowing the fluid off of the first and second deflectors in a substantially 360 degree spray pattern. In some embodiments, step (ii) includes flowing the fluid off of the first and second deflectors in a substantially 360 degree omni-directional spray pattern. In other embodiments, step (ii) includes flowing the fluid off the first and second deflectors in an approximately 270 degree spray pattern.

In some embodiments, step (ii) includes flowing the fluid off of the first and second deflectors in a substantially circumstantially symmetrical pattern about the nozzle body. In other embodiments, step (ii) includes flowing the fluid off of the first and second deflectors in a circumstantially asymmetrical pattern about the nozzle body. Some embodiments include preventing clogging of the slots by debris in the fluid passing therethrough.

Other objects, features and/or advantages will become apparent in view of the following detailed description of the embodiments and the accompanying drawings.

Although various objects, features and/or advantages have been described in this Summary and/or will become more readily apparent in view of the following detailed description and accompanying drawings, it should be understood that such objects, features and/or advantages are not required in all aspects and embodiments.

This Summary is not exhaustive of the scope of the present aspects and embodiments. Thus, while certain aspects and embodiments have been presented and/or outlined in this Summary, it should be understood that the present aspects and embodiments are not limited to the aspects and embodiments in this Summary. Indeed, other aspects and embodiments, which may be similar to and/or different from, the aspects and embodiments presented in this Summary, will be apparent from the description, illustrations and/or claims, which follow.

It should be understood that any aspects and embodiments that are described in this Summary and do not appear in the claims that follow are preserved for later presentation in this application or in one or more continuation patent applications. It should also be understood that any aspects and embodiments that are not described in this Summary and do not appear in the claims that follow are also preserved for later presentation or in one or more continuation patent applications.

BRIEF DESCRIPTION OF THE DRAWINGS

The foregoing features of the disclosure will be apparent from the following Detailed Description, taken in connection with the accompanying drawings, in which.

DETAILED DESCRIPTION OF EMBODIMENTS OF THE INVENTION

Figure 1:
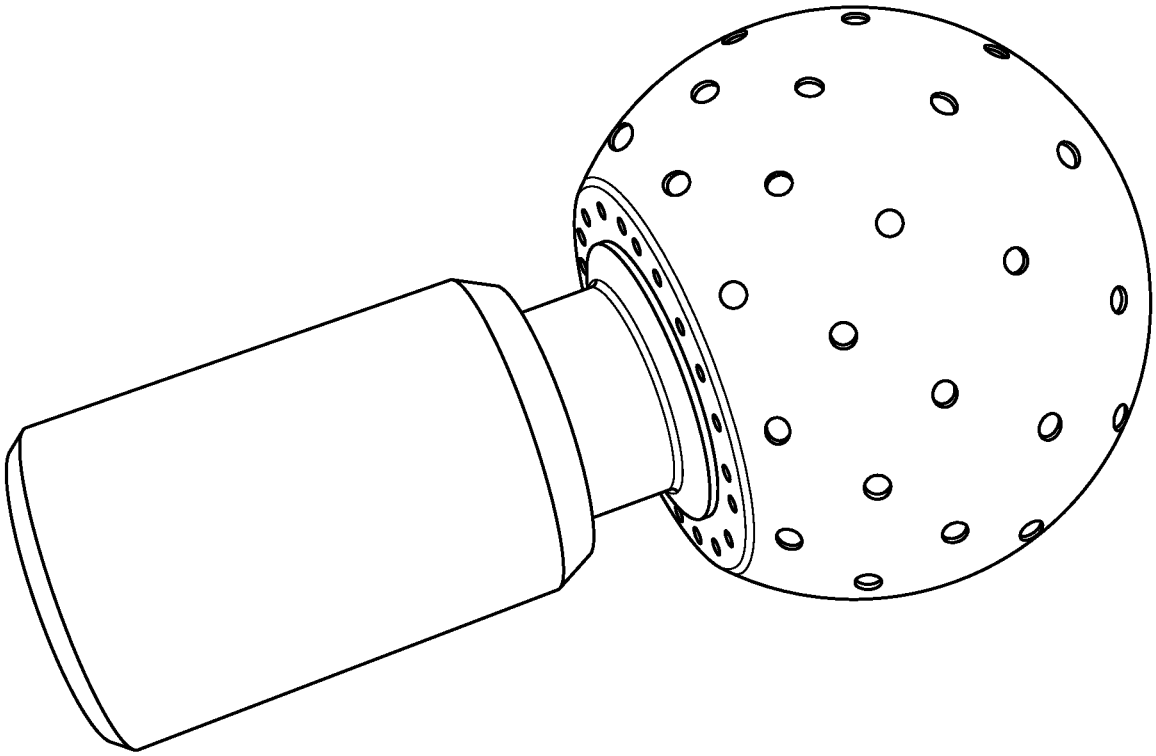
FIG. 1 (Prior Art)
FIG. 1 is a perspective view of a static spray ball nozzle.
Figure 2:
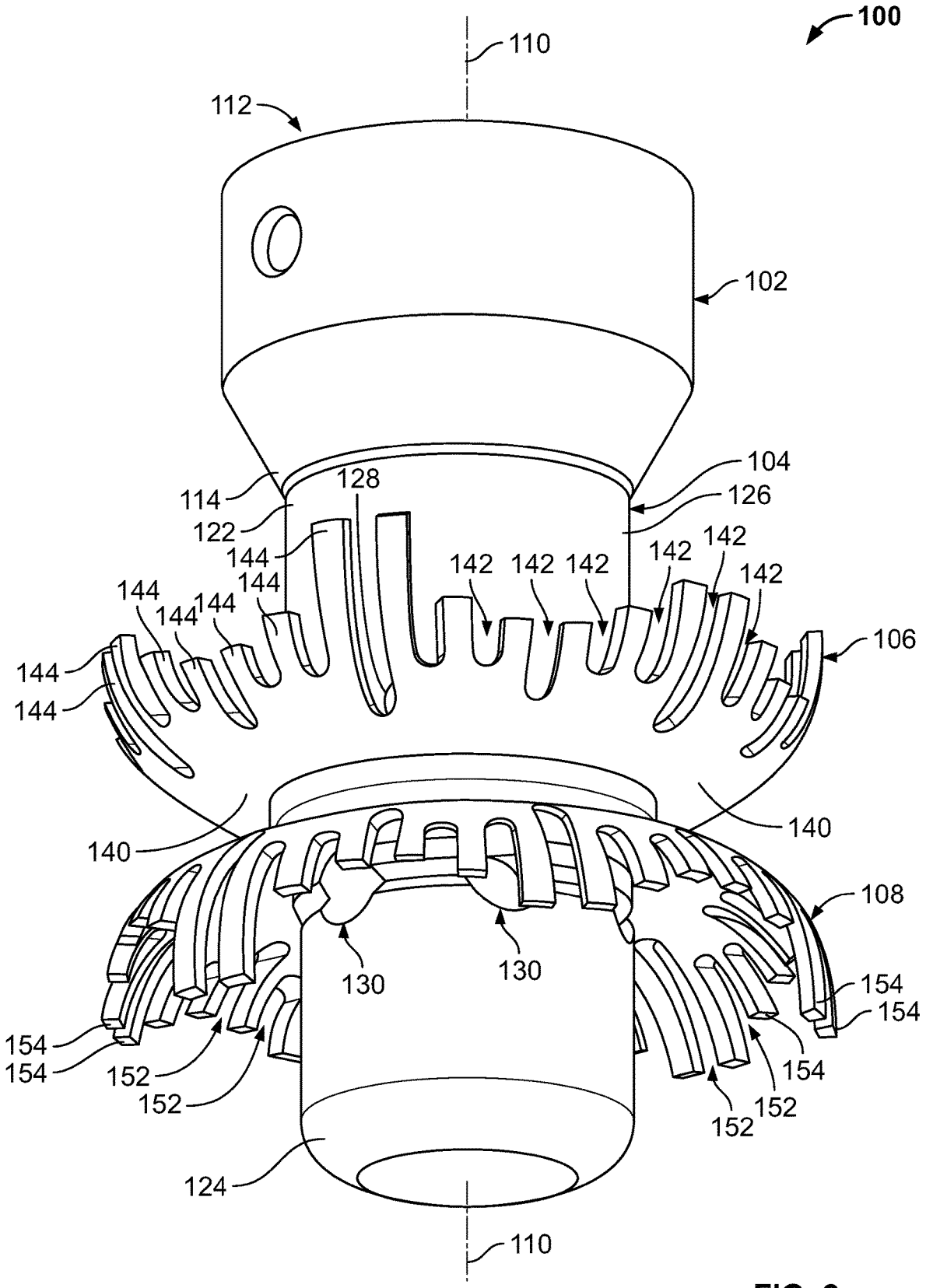
FIG. 2 is a bottom perspective view of a spray nozzle.
Figure 3:
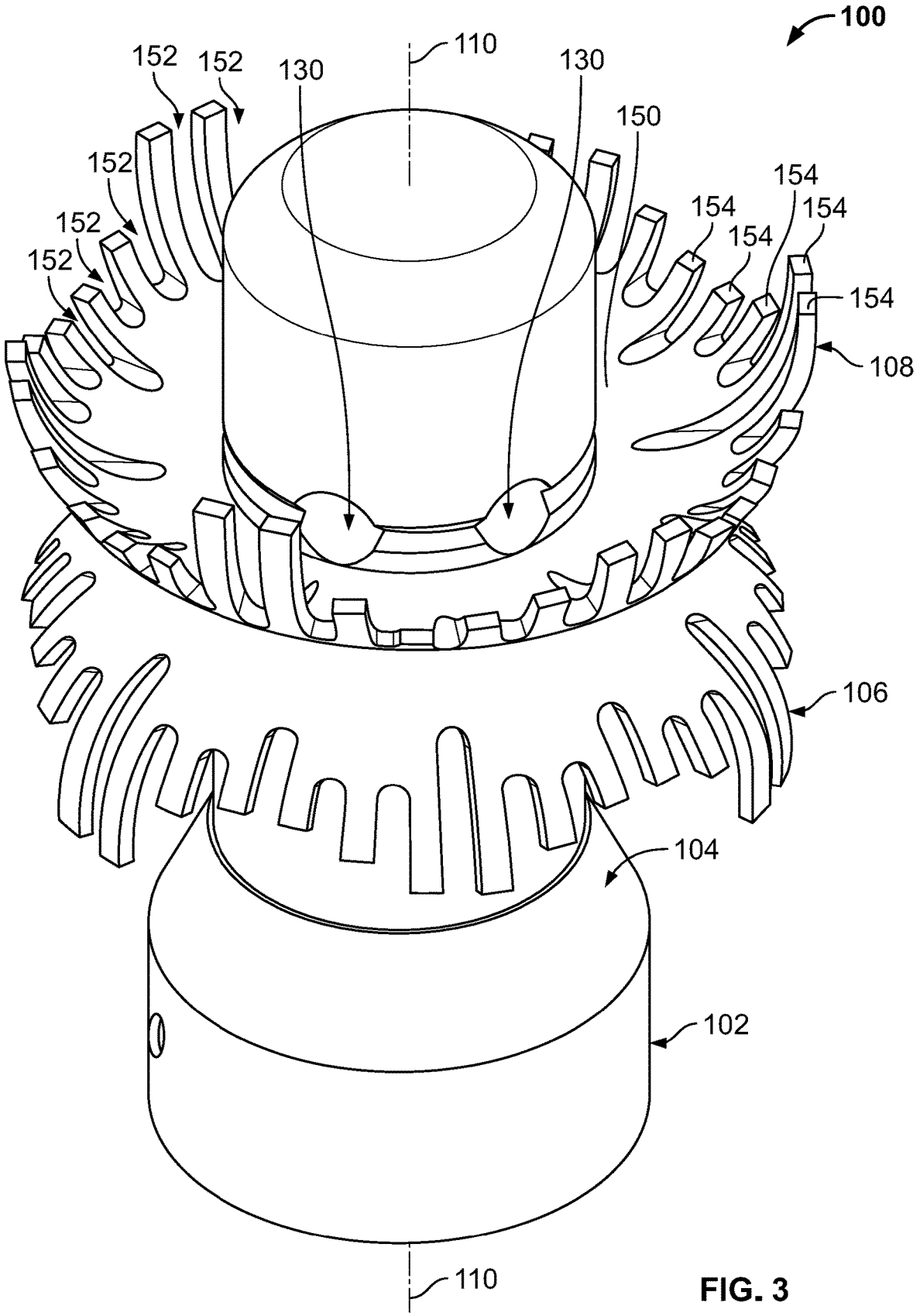
FIG. 3 is a top perspective view of the spray nozzle of FIG. 2.
Figure 4:
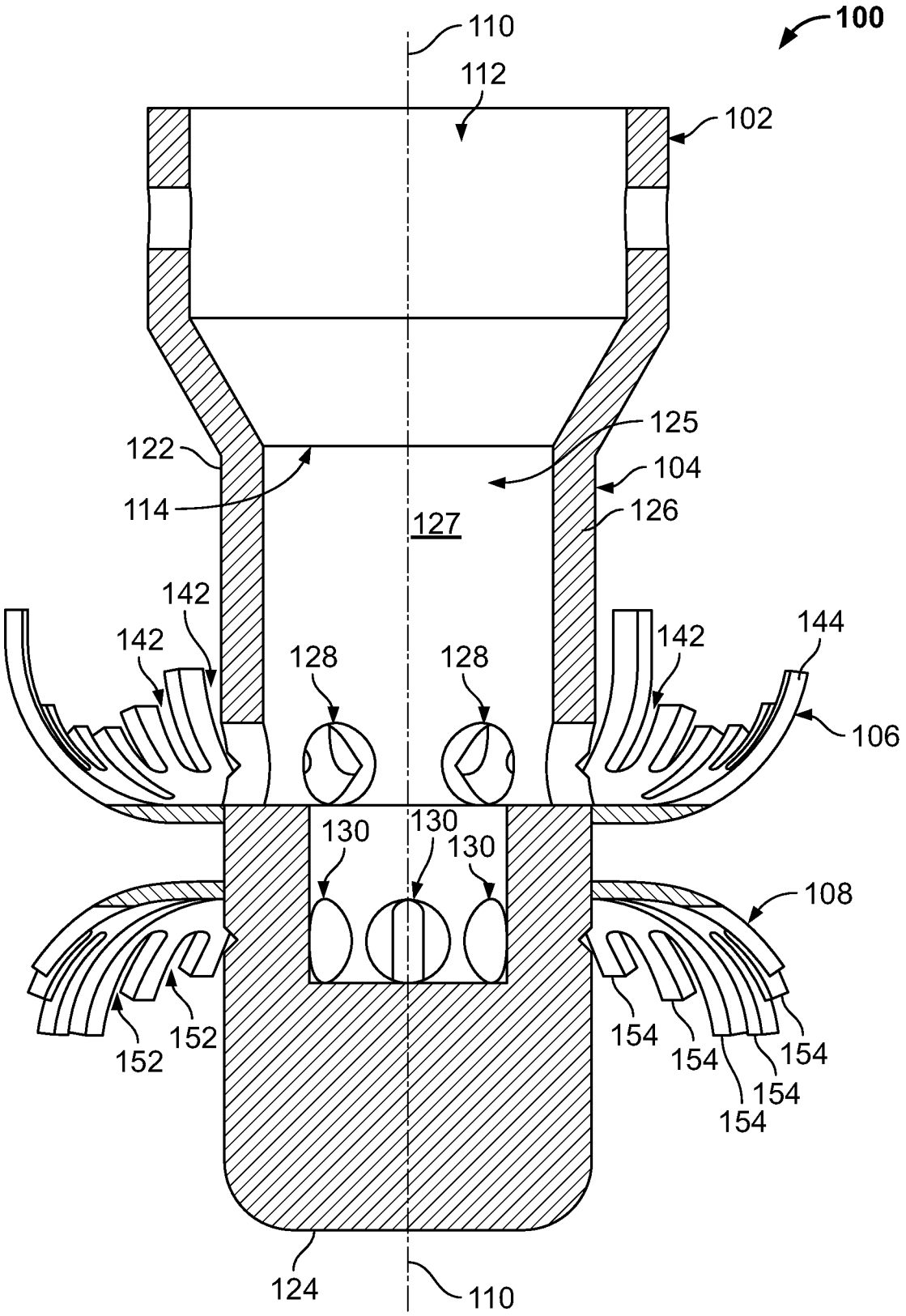
FIG. 4 is a schematic cross-sectional view of the spray nozzle of FIG. 2.

FIGS. 2-4 are views of a spray nozzle 100. In accordance with at least some embodiments, the spray nozzle 100 is configured to be connectable (directly or indirectly) with a source of pressurized fluid (not shown), e.g., water or a cleaning solution, and emit the pressurized fluid in a spray pattern therefrom.

The spray nozzle 100 may include a connector 102, a body 104, a first deflector 106 and a second deflector 108.

In some one or more of the connector 102, the body 104, the first deflector 106 and the second deflector 108 may be disposed circumferentially about an axis 110 (longitudinal or otherwise).

Unless stated otherwise, the phrase "disposed circumferentially about an axis" means disposed fully circumferentially about the axis, substantially circumferentially about the axis and/or only partly circumferentially about the axis, and thus does not require a complete circumference about the axis.

In addition, unless stated otherwise, a circumference need not be circular, substantially circular, or even partly circular.

Accordingly, while the spray nozzle 100 shown in FIGS. 2-4 is substantially circular in shape about the axis 110, in other embodiments, the spray nozzle is not circular, and may be of any desired shape for the selected application.

The connector 102 may be configured to connect to a source of fluid, e.g., water or cleaning solution, such as a pipe (not shown). The connector 102 may be directly connectable to the source of pressurized fluid and may define an inlet 112 to receive the pressured fluid, an outlet 114 to supply the pressurized fluid and a flow path therebetween. The connector 102 may be connected to the fluid source by any suitable mechanism, either currently known or developed in the future. In some embodiments, for example, the connector 102 may be secured or connected to a source of pressurized fluid via a retaining pin, a threaded connection and/or a welded/brazed connection. In embodiments where the connection is a threaded connection, the connector 102 may be internally or externally threaded to threadedly engage the external or internal threads of a pipe, tube or nozzle carrying the fluid to the spray nozzle 100. In some embodiments, the connector 102 may be oriented perpendicular to the body 104 rather than in line with the body 104.

The body 104 may be coupled to the connector 102 and may have a proximal end 122 and a distal end 124 and/or may define a fluid passageway 125 to flow fluid in a direction from the proximal end 122 toward the distal end 124.

In the illustrated embodiment, the body 104 and the connector 102 are integral. In other embodiments, they are separable and connected to each other by any suitable mechanism currently known or yet to be developed, e.g., welding, brazing, press fit or a threaded connection.

The body 104 may have an outer wall 126 disposed circumferentially about the axis 110. In the illustrated embodiment and at least some other embodiments, the outer wall 126 defines a cavity 127, at least in part, which defines, at least in part, the fluid passageway 125. The outer wall 126 may further define a first plurality of fluid-flow orifices 128 (one of which is best seen in FIG. 4) and a second plurality of fluid-flow orifices 130 that are in fluid communication with the fluid passageway 125, spaced circumferentially around the outer wall 126 and extend therethrough. In accordance with at least some embodiments, each of the first plurality of fluid-flow orifices 128 and each of the second plurality of fluid-flow orifices 130 may define a flow direction.

Unless stated otherwise, the phrase "spaced circumferentially around" means spaced fully circumferentially around, substantially circumferentially around and/or only partly circumferentially around, and thus does not require a complete circumference.

The first deflector 106 may be disposed circumferentially about the axis 110, radially outwardly of the body 104 and coupled thereto. In some embodiments, the first deflector 106 may include a base 140 that couples the first deflector 106 to the body 102.

In some embodiments, the first deflector 106 may define a concave shape, at least in part, and/or may have a configuration that is similar to a cup (or portion(s) thereof). Deflectors that have a configuration that is similar to a cup (or portion(s) thereof) are sometimes referred to herein as "deflection cups."

The first deflector 106 may be in fluid communication with the first plurality of fluid-flow orifices 128 and may define a first plurality of slots 142 that are spaced circumferentially about the first deflector. In accordance with at least some embodiments, each one of the first plurality of slots may be in fluid communication with at least one of the first plurality of fluid-flow orifices and may define an angle relative to the flow direction defined by a respective one of said fluid-flow orifices.

In accordance with at least some embodiments, the angle defined by one of the first plurality of slots may be different from the angle defined by another of the first plurality of slots.

In at least some embodiments, the first plurality of slots may extend outwardly along the first deflector and toward the proximal end of the body 104.

Unless stated otherwise, a slot may have any size and shape. In addition, unless stated otherwise, a slot may or may not extend all the way to an inner perimeter and/or outer perimeter of the deflector. Thus, in some embodiments, a slot may be bounded.

Unless stated otherwise, the phrase "spaced circumferentially about" means spaced fully circumferentially about, substantially circumferentially about and/or only partly circumferentially about, and thus does not require a complete circumference.

Unless stated otherwise, the phrase "extend toward" means extend toward in at least some respect and/or to at least some degree.

The first deflector 106 may further define a first plurality of members or fingers 144 that are spaced circumferentially about the first deflector 106. In accordance with at least some embodiments, each one of the first plurality of fingers may be in fluid communication with at least one of the first plurality of fluid-flow orifices and may define an angle relative to the flow direction defined by a respective one of said fluid-flow orifices. In accordance with at least some embodiments, the angle defined by one of the first plurality of fingers may be different from the angle defined by another of the first plurality of fingers. In some embodiments, at least some of the first plurality of fingers defines a plurality of such angles along its length.

In accordance with at least some embodiments, the first plurality of fingers may extend outwardly along the first deflector and toward the proximal end 122 of the body 104.

Unless stated otherwise, a finger may have any size and shape.

In addition, unless stated otherwise, a finger may or may not have a free end. Thus, in some embodiments, the end of a finger may be coupled to an end of one another finger or something else.

Circumferentially successive ones of the first plurality of slots 142 may be spaced apart from one another at least in part by a respective one of the first plurality of fingers 144. Circumferentially successive ones of the first plurality of fingers 144 may be spaced apart from one another at least in part by a respective one of the first plurality of slots 142.

The second deflector 108 may be disposed circumferentially about the axis 110, radially outwardly of the body 104 and coupled thereto. In some embodiments, the second deflector 108 may include a base 150 (seen best in FIG. 3) that couples the second deflector 108 to the body 104.

In some embodiments, the second deflector 108 may define a concave shape, at least in part, and/or may have a configuration that is similar to a cup (or portion(s) thereof).

The second deflector 108 may be in fluid communication with the second plurality of fluid-flow orifices 130 and may define a second plurality of slots 152 that are spaced circumferentially about the second deflector extend outwardly along the second deflector and toward the distal end 124 of the body 104. In accordance with at least some embodiments, each one of the second plurality of slots may be in fluid communication with at least one of the second plurality of fluid-flow orifices and may define an angle relative to the flow direction defined by a respective one of said fluid-flow orifices.

In accordance with at least some embodiments, the angle defined by one of the second plurality of slots may be different from the angle defined by another of the second plurality of slots.

The second deflector 108 may further define a second plurality of members or fingers 154 that are spaced circumferentially about the second deflector 108. In accordance with at least some embodiments, each one of the second plurality of fingers may be in fluid communication with at least one of the second plurality of fluid-flow orifices and may define an angle relative to the flow direction defined by at least one of the second plurality of fluid-flow orifices in fluid communication with the one of the second plurality of fingers. In some embodiments, at least some of the first plurality of fingers defines a plurality of such angles along its length. In accordance with at least some embodiments, the angle defined by one of the second plurality of fingers may be different from the angle defined by another of the second plurality of fingers.

In accordance with at least some embodiments, the second plurality of fingers may extend outwardly along the second deflector and toward the distal end 124 of the body 104.

In accordance with at least some embodiments, circumferentially consecutive ones of the second plurality of slots 152 may be spaced apart from one another at least in part by a respective one of the second plurality of fingers 154. Circumferentially successive ones of the second plurality of fingers 154 may be spaced apart from one another at least in part by a respective one of the second plurality of slots 152.

In accordance with at least some embodiments, pressurized fluid enters the nozzle 100, e.g., through the connector 102, passes through the body 104 and exits through the plurality of fluid-flow orifices 128, 130, with the trajectory controlled at least in part by the plurality of slots 142, 152 and the plurality of fingers 144, 154.

In accordance with at least some embodiments, the connector 102, body 104, first deflector 106 and second deflector 108 are not limited to the configurations shown. In accordance with at least some embodiments, each may have any configuration that is suitable to requirements of a particular embodiment. In some embodiments, the connector 102, the body 104, the first deflector 106 and the second deflector 108 may each be symmetrical and/or centered about the axis 110. In some embodiments, one or more of the connector 102, the body 104, the first deflector 106 and the second deflector 108 may not be symmetrical and/or not centered about the axis 110.

In accordance with at least some embodiments, each slot and finger acts in controlling where fluid in flow communication therewith will spray (or otherwise flow). As fluid flows along the deflector, it will separate from the deflector when it encounters a slot or the end of a finger. Depending upon the location and angle (relative to the axis 110 or the fluid flow) of the slot or finger end, the fluid flow will separate at a certain trajectory. Accordingly, as should be appreciated by those of ordinary skill in the art, a desired fluid trajectory can be designed by providing a slot or finger end with a location and/or angle that produces the desired trajectory.

In accordance with at least some embodiments, each one of the slots results in a flow having a trajectory relative to the axis 110 (and/or the direction of fluid flow through the body), and a slot circumferentially consecutive to such one of the slots may have a configuration that is different than the one of the slots and results in a flow having a different trajectory relative to the axis 110 (and/or the direction of fluid flow through the body).

In accordance with at least some embodiments, each one of the fingers results in a flow having a trajectory relative to the axis 110 (and/or the direction of fluid flow through the body 104), and a finger circumferentially consecutive to such one of the fingers may have a configuration that is different than the one of the fingers and results in a flow having a different trajectory relative to the axis 110 (and/or the direction of fluid flow through the body 104).

In accordance with some embodiments, each trajectory may be in a range of from 0 degrees to 90 degrees relative to the axis 110. In accordance with some embodiments, each trajectory may be in a range of from 90 degrees to 180 degrees relative to the direction of fluid flow through the body 104.

In accordance with at least some embodiments, each of the first plurality of slots 142 may have a configuration that defines, at least in part, a flow trajectory, and the flow trajectory defined, at least in part, by the configuration of at least one of the first plurality of slots 142 may be different than the flow trajectory defined, at least in part, by the configuration of at least one other of the first plurality of slots 142.

In accordance with at least some embodiments, each of the first plurality of fingers 144 may have a configuration that defines, at least in part, a flow trajectory, and the flow trajectory defined, at least in part, by the configuration of at least one of the first plurality of fingers 144 may be different than the flow trajectory defined, at least in part, by the configuration of at least one other of the first plurality of fingers 144.

In accordance with at least some embodiments, each of the second plurality of slots 152 may have a configuration that defines, at least in part, a flow trajectory, and the flow trajectory defined, at least in part, by the configuration of at least one of the second plurality of slots 152 may be different than the flow trajectory defined, at least in part, by the configuration of at least one other of the second plurality of slots 152.

In accordance with at least some embodiments, each of the second plurality of fingers 154 may have a configuration that defines, at least in part, a flow trajectory, and the flow trajectory defined, at least in part, by the configuration of at least one of the second plurality of fingers 154 may be different than the flow trajectory defined, at least in part, by the configuration of at least one other of the second plurality of fingers 154.

In accordance with at least some embodiments, the first plurality of slots 142 and first plurality of fingers 144 define an array of slot lengths/widths/directions and finger lengths/widths/directions such that in congregate, the nozzle 100 emits a fluid spray pattern that covers and cleans a desired surface area. In some embodiments, the array is defined so as to cover and clean as much of an interior surface of a tank (or other type of vessel (which may or may not be an enclosure)) as possible. In accordance with some embodiments, the fluid spray pattern covers and cleans an entire or nearly the entire interior surface of a tank (or other type of vessel (which may or may not be an enclosure)).

In accordance with some embodiments, the nozzle provides a 360 degree spray pattern.

In accordance with some embodiments, each of the plurality of slots 142, 152 and each of the plurality of fingers 144, 154 have a same width. In accordance with some embodiments, one or more of the plurality of slots 142, 152 has a width that is different from a width of other slots and or of one or more of the plurality of fingers 144, 154. In accordance with some embodiments, one or more of the plurality of fingers 144, 154 has a width that is different from a width of other fingers 144, 154. In accordance with some embodiments, each of the plurality of slots 142, 152 and each of the plurality of fingers have a different width 144, 154.

In accordance with at least some embodiments, the configuration (size, shape, orientation and/or any other aspect of the configuration) of the slots in the first plurality of slots 142 vary from slot to slot. In accordance with at least some embodiments, the variation may define a repeating pattern on the first deflector 106. In accordance with some embodiments, consecutive slots may have different configurations from one another. In accordance with some embodiments, the repeating pattern may repeat every 90 degrees on the first deflector 106. In accordance with some embodiments, the repeating pattern may repeat every 90 degrees or 120 degrees on the first deflector 106. In certain embodiments, the pattern is symmetric.

In accordance with at least some embodiments, the configuration of the fingers (size, shape, orientation and/or any other aspect of the configuration) in the first plurality of fingers 144 vary from finger to finger and the variation defines a repeating pattern. In accordance with at least some embodiments, the variation may define a repeating pattern on the first deflector 106. In accordance with some embodiments, consecutive fingers may have different configurations from one another. In accordance with some embodiments, the repeating pattern may repeat every 90 degrees or 120 degrees on the first deflector 106. In certain embodiments, the pattern is symmetric.

In accordance with at least some embodiments, the configuration (size, shape, orientation and/or any other aspect of the configuration) of the slots in the second plurality of slots 152 vary from slot to slot. In accordance with at least some embodiments, the variation may define a repeating pattern on the second deflector 108. In accordance with some embodiments, consecutive slots may have different configurations from one another. In accordance with some embodiments, the repeating pattern may repeat every 90 degrees or 120 degrees on the second deflector 108. In certain embodiments, the pattern is symmetric.

In accordance with at least some embodiments, the configuration of the fingers (size, shape, orientation and/or any other aspect of the configuration) in the second plurality of fingers 154 vary from finger to finger and the variation defines a repeating pattern. In accordance with at least some embodiments, the variation may define a repeating pattern on the second deflector 108. In accordance with some embodiments, consecutive fingers may have different configurations from one another. In accordance with some embodiments, the repeating pattern may repeat every 90 degrees or 120 degrees on the second deflector 108. In certain embodiments, the pattern is symmetric.

As stated above, in accordance with at least some embodiments, the nozzle 100 may be a static (non-rotating) 360 degree tank wash nozzle with a free passage diameter that is, on average, at least two times larger than that of a comparable spray ball. The nozzle 100 may have a limited number of large-diameter orifices 128, 130 (or orifices of other configuration) to create heavy straight jets that are then dispersed by deflectors 106, 108 (which may comprise first and second deflection cups, respectively) designed to disperse the jets in a desired spray pattern or other dispersion. These deflection cups (or other deflector configurations) may be provided with a plurality of slots 142, 152 and a plurality of fingers 144, 154 to help break or disperse the jets into a substantially uniform or even uniform 360 degree omni-directional spray pattern. In accordance with at least some embodiments, because the orifices are larger than those of a static spray ball of comparable flow rate and rated washing diameter, and the deflection cups (or other deflector configurations) are constantly self flushing with no geometry to capture or catch debris, such nozzle 100 is substantially more resistant to clogging than a static spray ball of comparable flow rate and rated washing diameter. In accordance with at least some embodiments, the nozzle 100 has no moving parts, making it more reliable with less maintenance, and, in some embodiments, maintenance-free, than a comparably-sized rotating nozzle. In accordance with at least some embodiments, the design is manufacturable in a way that maintains good surface finish, crevice-free joints, and self-draining function to meet sanitary requirements for certain industries and applications. In accordance with at least some embodiments, a uniform 360 degree omni-directional spray pattern is provided that accomplishes complete coverage of the vessel walls in a much shorter time than jet nozzle designs.

In accordance with at least some embodiments, one of the most visually striking features of the nozzle 100 may be the slotted deflection cups (or other slotted deflector configurations).

In accordance with at least some embodiments, a complete nozzle assembly consists of three components: one nozzle body 104 and two deflection cups (or other deflector configurations).

In accordance with at least some embodiments, two deflection cups (or other deflector configurations) produce a full 360 degree omni-directional spray because each cup can deflect a series of jets into one 180 degree hemisphere of coverage. The cup geometry, slot width and depth, and "finger" width and height contribute to achieving a sufficiently uniform spray coverage or other desired coverage on the vessel interior walls.

In accordance with at least some embodiments, when water or other fluid (e.g., a cleaning fluid composition) exits the nozzle orifices 128, 130, it begins to fan out and create a fluid sheet on the curved interior surface of the deflection cup (or other deflector configurations). As this sheet then encounters each slot, a strip of water/fluid will break from the sheet and spray at a trajectory tangent to the deflection surface at the base of that slot. Likewise, as this sheet of water encounters the end of a "finger," the sheet will break away at a spray trajectory tangent to the deflection surface at the end of that finger. As such, the slots and fingers may be designed with the necessary depths/heights in order to distribute liquid in the proper spray angle intervals to produce a virtual 360 degree or other desired coverage pattern. The deepest slots in the deflection cups (or other deflector configurations) are, in some embodiments, aligned centered in front of the orifices in the nozzle body.

In accordance with at least some embodiments, design guidelines for sanitary applications require that permanent joints between multiple components are crevice-free. As such, in accordance with some embodiments, the deflection cups (or other deflector configurations) may be installed on the nozzle body and joined by continuous welding, press or shrink interference fit, or another installation method not yet determined that will accomplish a crevice free joint.

In accordance with at least some embodiments, the two cups (or other deflector configurations), when installed, have an adequate gap in between them so that a tight crevice is not created. By leaving a gap between the two cups (or other deflector configurations), all exterior nozzle surfaces are accessible for cleaning.

In accordance with at least some embodiments, the connector 102 (or another portion of the) nozzle 100 may be connected to the supply pipe by sanitary clip on connection, pipe threads, welding, or other specialty fittings such as gasketed tri-clamp connections.

In accordance with at least some embodiments, the nozzle 100 may have several orifices 128, 130 that are drilled or otherwise formed radially into the nozzle body 104 and evenly spaced around an outside diameter of the body 104. In accordance with at least some embodiments, orifices 128, 130 are located on two planes at different distances along the axial length of the body 104 from the inlet 112. These planes are located so that the orifice diameters are tangent to the inside deflection surfaces of each deflection cup to achieve proper spray performance.

In accordance with at least some embodiments, while both planes may have the same number of orifices (in other embodiments, they have a different number of orifices), the upper orifices 128 to the lower orifices 130 are rotationally or circumferentially misaligned. In some such embodiments, they are misaligned by one-half of the orifice spacing. Spray coverage at the equator of the vessel interior is achieved by having the deepest slots aligned directly in front of the nozzle orifices so misaligning the upper and lower orifices allows for the most even distribution possible in this region of coverage.

In accordance with at least some embodiments, desired engineering practices for the design of tank washing nozzles require that nozzle assemblies be completely self-draining to prevent possible "pooling" of water that can foster growth of bacteria. In accordance with some embodiments, the nozzle 100 is designed so that it is completely self-draining in the typical vertical installation orientation.

As noted previously, in accordance with at least some embodiments, the deflection cups 106, 108 may be located on the nozzle body 104 so that the inner deflection surfaces are tangent to the nozzle orifice diameters. In addition to providing proper spray performance, this allows any water that may remain in the upper cup to flow back into the nozzle body 104 and drain through the lower orifices.

In accordance with at least some embodiments, the internal geometry of the body 104 itself is designed with self-draining function in mind. In some embodiments, in order for water to completely drain from the nozzle body interior in the vertical installation orientation, either the lower plane of orifices 130 have their diameters tangent to the bottom-most point of the internal body cavity 127 (as shown in FIG. 4) or the internal cavity 127 funnels any remaining liquid into a drain hole through the bottom of the nozzle body (not shown).

In the illustrated embodiment, the internal body cavity 127 is defined, in part by a flat bottom bore and the lower orifices are tangent to the bottom surface in order to make it self-draining.

In accordance with at least some embodiments, the spray nozzle 100 may be constructed entirely from metal alloy, polymer, or another suitable material (or combinations thereof) as process conditions may require or may be desired for one or more reasons.

In some embodiments, the body 104 and the deflectors 106, 108 may be integral. In other embodiments, they are separable and connected to each other by any suitable mechanism currently known or yet to be developed, e.g., welding, brazing, press fit or a threaded connection.

In accordance with at least some embodiments, one or more of the deflection cups (or other deflector 106, 108 configurations) may be made or otherwise fabricated from formed sheet metal.

In accordance with at least some embodiments, the formed sheet metal may be formed by cutting or otherwise forming sheet metal in accordance with a suitable flat or other type of pattern.

In accordance with at least some embodiments, the formed sheet metal may be formed by cutting or otherwise forming sheet metal using a suitable forming or other type of die.

In at least some embodiments, the sheet metal deflector cup is bent or shaped into the desired shape and/or configuration.

In accordance with some embodiments, one or more of the deflectors 106, 108 (which may comprise first and second deflection cups, respectively) may be machined or otherwise fabricated from a billet (e.g., a solid block of material), or any other form or configuration of material.

In some embodiments, one or more of the deflectors 106, 108 may be made of a suitable material or materials (e.g., stainless steel or other suitable material(s)).

As stated above, in many industries, such as winemaking, brewing and food processing, a cleaning solution is often recirculated, which means that leftover debris in the vessel could potentially be pumped into the spray nozzle.

In accordance with at least some embodiments, the first plurality of fluid-flow orifices 128 and the second plurality of fluid-flow orifices 130 are sized as small as possible, taking into consideration the size of the debris, the shape of the debris and the amount of debris (sometimes collectively referred to herein as a "debris load") that may be present in the pressurized fluid received and/or emitted by the spray nozzle, so that the first plurality of fluid-flow orifices 128 and the second plurality of fluid-flow orifices 130, do not clog with debris. That is, the first plurality of fluid-flow orifices 128 and the second plurality of fluid-flow orifices 130 may be of minimum dimensions necessary to prevent clogging of the first plurality of fluid-flow orifices 128 and the second plurality of fluid-flow orifices 130, for a particular fluid/debris flow being passed through the spray nozzle 100.

In accordance with at least some embodiments, the first plurality of slots 142 and the second plurality of slots 152 have a width that is as small as possible, taking into consideration the debris load that may be present in the pressurized fluid received and/or emitted by the spray nozzle, so that the first plurality of slots 142 and the second plurality of slots 152 do not clog with debris. That is, the first plurality of slots 142 and the second plurality of slots 152 have a minimum width necessary to prevent clogging of the first plurality of slots 142 and the second plurality of slots 152, for a particular fluid/debris flow being passed through the spray nozzle 100.

In accordance with at least some embodiments, consecutive ones of the first plurality of fingers 144 are spaced apart by a first spacing that is as small as possible and consecutive ones of the second plurality of fingers 154 are spaced apart by a second spacing that is as small as possible, taking into consideration the debris load that may be present in the pressurized fluid received and/or emitted by the spray nozzle, so that the first spacing and the second spacing do not clog with debris. That is, the first spacing and the second spacing may be a minimum size necessary to prevent clogging of the first spacing and the second spacing, for a particular fluid/debris flow being passed through the spray nozzle.

In some embodiments, a spray pattern of less than 360 degree may be suitable or otherwise suffice.

In some embodiments, a 180 degree or substantially 180 degree spray pattern may be suitable or otherwise suffice.

Thus, in accordance with some embodiments, the spray nozzle 100 need not include a second deflector.

In accordance with at least some embodiments, the spray nozzle 100 may produce or substantially produce a 180 degree spray pattern that is omni-directional within such spray pattern (sometimes referred to herein as a 180 degree omni-directional spray pattern).

In accordance with at least some embodiments, a uniform or nearly uniform 180 degree omni-directional spray pattern can be achieved.

In some embodiments, the first deflector 106 and second deflector 108 are made using or from different materials or fabrication methods.

In some embodiments, the first and second deflectors 106, 108 are attached to the nozzle body 104 using different attachment methods.

It should be understood that the nozzle 100 features disclosed herein can be used in any combination or configuration, and is not limited to the particular combinations or configurations expressly specified or illustrated herein.

Figure 5:
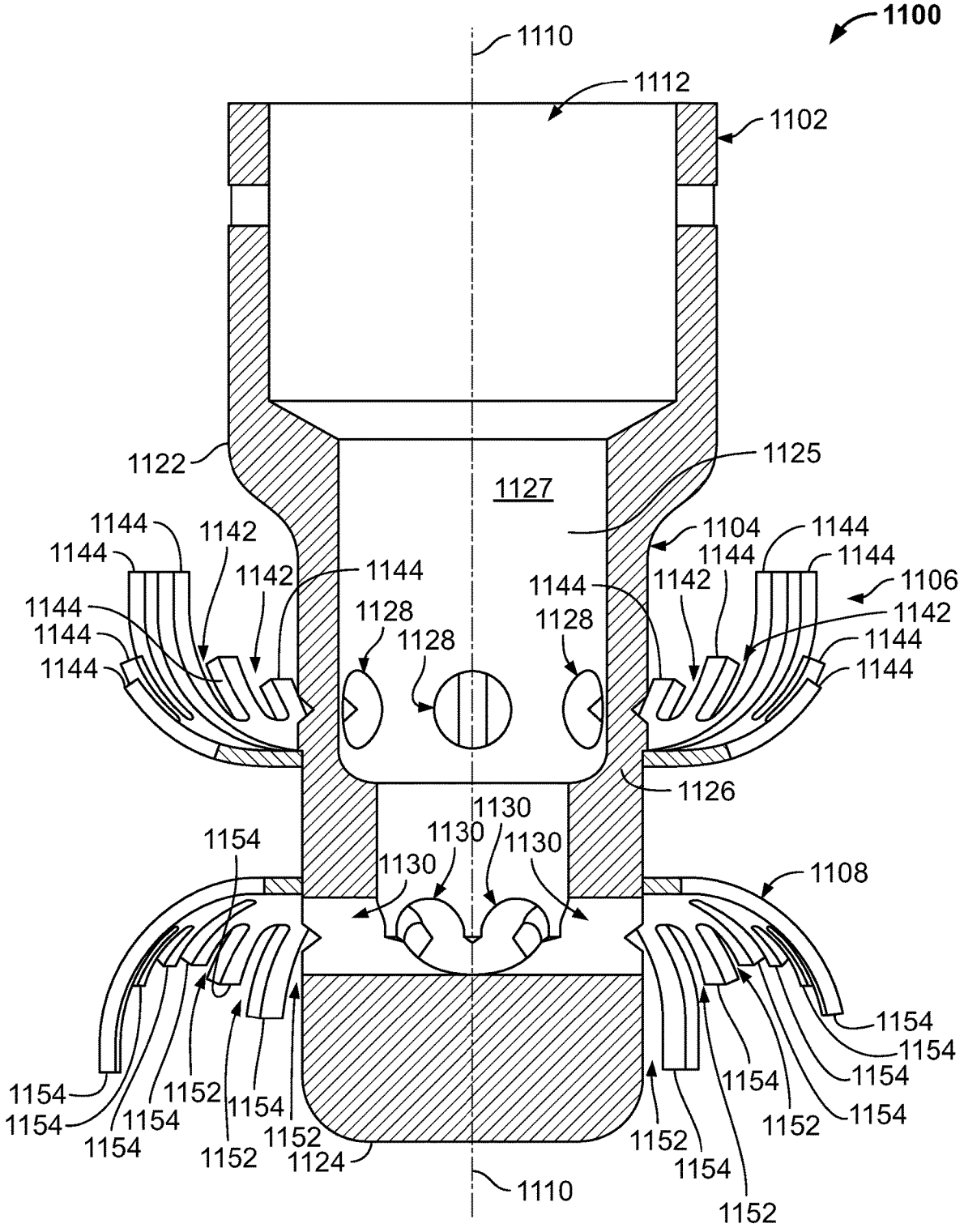
FIG. 5 is schematic cross-sectional view of another embodiment of a spray nozzle.

FIG. 5 is schematic cross-sectional view of another embodiment of a spray nozzle 1100. In accordance with some embodiments, the features of the spray nozzle 1100 may be the same and/or similar to those of the spray nozzle 100 (except where otherwise noted, like reference numerals differing only by the presence of the numeral "1" in the thousands place are used to indicate like or similar elements) except as indicated herein.

In accordance with some embodiments, in order for water to completely drain from the nozzle body interior in the vertical installation orientation, the lower orifices all meet at the axis 1110 (which may comprise a center axis of the body 1104) to create or otherwise define a self-draining bottom. In accordance with some embodiments, the cavity 1127 may be defined, in part, by a lower bore section, which may be defined by a drill point that terminates before reaching a lower-most surface (which may be a lower-most surface of one, some or all of the lower orifices). In accordance with some embodiments, use of this type of design may make it is easier to machine the body while preserving self-draining functionality.

In accordance with some embodiments, the spray nozzle 1100 may include a small step or other feature on an outside diameter of the body section 1104 as a locating feature for the first deflector 1106 (which in some embodiments may be an upper deflection cup) during the welding assembly.

In accordance with some embodiments, the body 1104 and the deflectors 1106, 1108 may be connected to each other by welding. Some embodiments do not include the small step or other locating feature on the outside diameter of the body 1104 unless the body 1104 and the first deflector 1106 are connected to each other by welding, since without welding, space between the step or other locating feature and the first deflector 1106 could create an un-sanitary crevice.

In accordance with at least some embodiments, the spacing between the first deflector 1106 and the second deflector 1108 (which in some embodiments may be a lower deflection cup) may be slightly greater than the spacing between the first deflector 106 and the second deflector 108. In some embodiments, this may be strictly for the purpose of accessibility with the welder.

In accordance with at least some embodiments, the spacing between the first deflector 1106 and the second deflector 1108 is selected to provide accessibility for welding.

In accordance with at least some embodiments the first and second deflectors 1106, 1108 (which may comprise first and second deflection cups, respectively) may be formed using flat sheet metal patterns and tooling.

In some embodiments, the first deflector 1106 and second deflector 1108 are made using or from different materials or fabrication methods.

In some embodiments, the first and second deflectors 1106, 1108 are attached to the nozzle body 1104 using different attachment methods.

It should be understood that the nozzle 1100 features disclosed herein can be used in any combination or configuration, and is not limited to the particular combinations or configurations expressly specified or illustrated herein.

Figure 6:
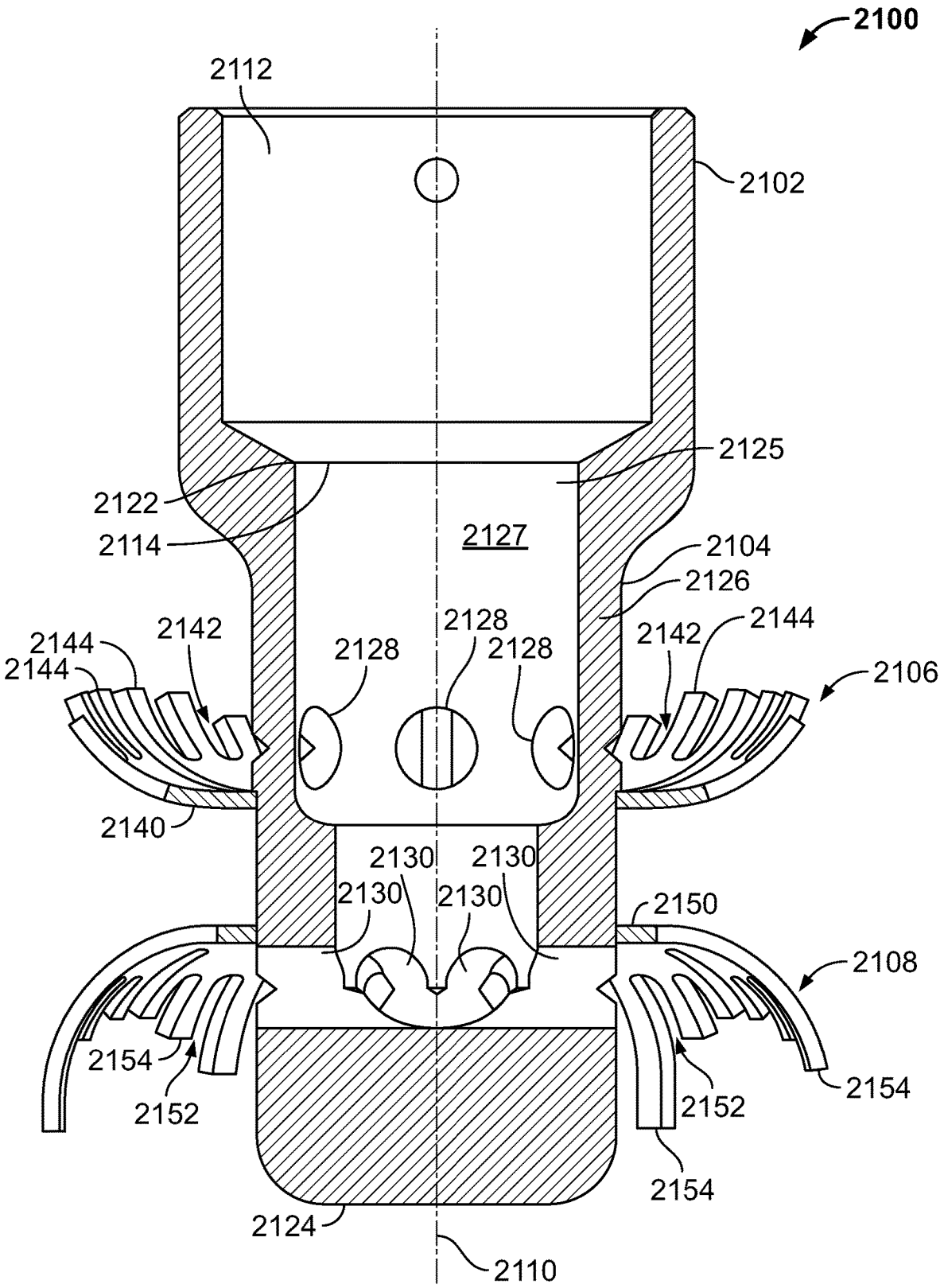
FIG. 6 is schematic cross-sectional view of another embodiment of a spray nozzle.

FIG. 6 is schematic cross-sectional view of another embodiment of a spray nozzle 2100. In accordance with some embodiments, the features of the spray nozzle 2100 may be the same and/or similar to those of the spray nozzles 100 and 1100 (except where otherwise noted, like reference numerals differing only by the presence of the numeral "2" in the thousands place are used to indicate like or similar elements) except as indicated herein.

Spray nozzle 2100 produces or substantially produces a 270 degree spray pattern that, in at least some embodiments, is omni-directional within such spray pattern (sometimes referred to herein as a 270 degree omni-directional spray pattern). Spray nozzle 2100 has a first deflector 2106 and a second deflector 2108. Second deflector 2108 is similar to second deflector 108 of spray nozzle 100 and second deflector 1108 of spray nozzle 1100 in that it generates a 180 degree (e.g., uniform, omni-directional) spray pattern. On the other hand, the first deflector 2106 generates or substantially generates a 90 degree spray pattern. In the illustrated embodiment, the slots 2142 and fingers 2144 are configured so that the tangential trajectories of the fluid from the deflection surfaces of the bases of the slots 2142 and ends of the fingers 2144 form or substantially form a 90 degree spray pattern. For example, as depicted in the illustrated embodiment, none of the slots 2142 or fingers 2144 defines a tangent trajectory greater than about 45 degrees from the horizontal direction. Accordingly, no or little spray is directed in the proximal direction within a cone-shaped area adjacent the axis 2110. In the illustrated embodiment, the cone-shaped area defines an included angle of about 90 degrees, e.g., about 45 degrees to either side of the axis 2110. The result is that the first and second deflectors 2106, 2108 together generate a 270 degree spray pattern.

Figure 7:
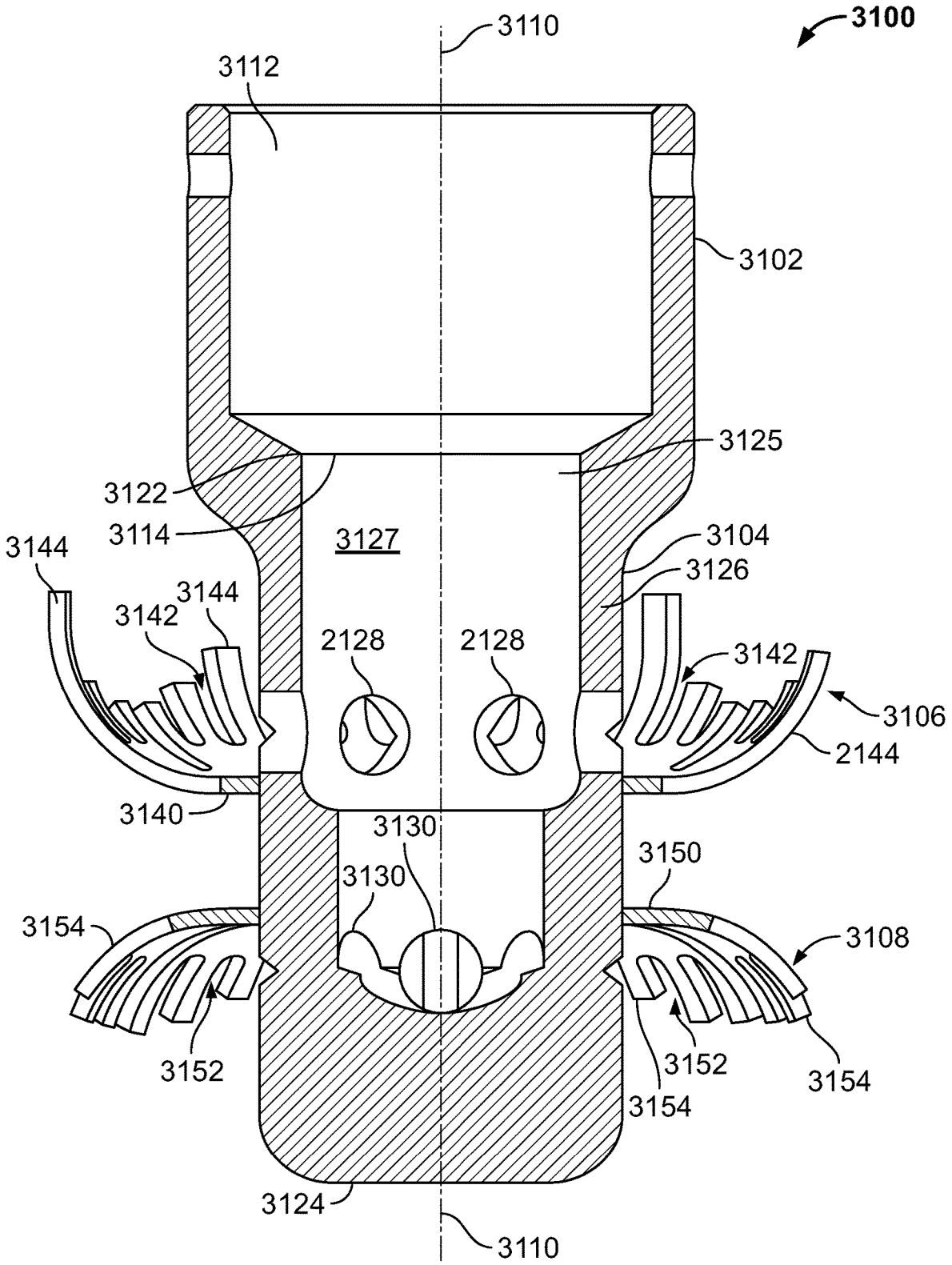
FIG. 7 is schematic cross-sectional view of another embodiment of a spray nozzle.

FIG. 7 is schematic cross-sectional view of another embodiment of a spray nozzle 2100. In accordance with some embodiments, the features of the spray nozzle 3100 may be the same and/or similar to those of the spray nozzles 100, 1100 and 2100 (except where otherwise noted, like reference numerals differing only by the presence of the numeral "3" in the thousands place are used to indicate like or similar elements) except as indicated herein.

Spray nozzle 3100 produces or substantially produces a 270 degree spray pattern that, in at least some embodiments, is omni-directional within such spray pattern (sometimes referred to herein as a 270 degree omni-directional spray pattern). Spray nozzle 3100 has a first deflector 3106 and a second deflector 3108. First deflector 3106 is similar to second deflector 106 of spray nozzle 100 and second deflector 1106 of spray nozzle 1100 in that it generates a 180 degree (e.g., uniform, omni-directional) spray pattern. On the other hand, the second deflector 3108 generates or substantially generates a 90 degree spray pattern. In the illustrated embodiment, the slots 3152 and fingers 3154 are configured so that the tangential trajectories of the fluid from the deflection surfaces of the bases of the slots 3152 and ends of the fingers 3154 form or substantially form a 90 degree spray pattern. For example, as depicted in the illustrated embodiment, none of the slots 3152 or fingers 3154 defines a tangent trajectory greater than about 45 degrees from the horizontal direction. Accordingly, no or little spray is directed in the distal direction within a cone-shaped area adjacent the axis 3110. In the illustrated embodiment, the cone-shaped area defines an included angle of about 90 degrees, e.g., about 45 degrees to either side of the axis 3110. The result is that the first and second deflectors 3106, 3108 together generate a 270 degree spray pattern.

In the illustrated embodiments of FIGS. 6 and 7, the 90 degree spray patterns generated, respectively, by the first deflector 2106 and the second deflector 3108, are at least substantially uniform and/or omni-directional. That is, for example, the spray pattern is substantially uniform about the respective axes 2110, 3110.

However, as should be understood by those of ordinary skill in the art, the 90 degree spray pattern generated by first deflector 2106 and second deflector 3108 may be of any desired shape or pattern, which is controlled by the configuration of the slots and fingers, e.g., the lengths of the slots and fingers and angles of the deflection surfaces thereof. By way of example, the 90 degree (or other angle) shape of the spray pattern may not be symmetric with respect to the nozzle axis, e.g., laterally and/or circumferentially. As but one example, on one side of the axis, the deflection surfaces may define a maximum trajectory tangent of more than 45 degrees. On the other side of the axis, the deflection surfaces may define a maximum trajectory tangent of less than 45 degrees. Accordingly, while the deflector may as a whole generate a spray pattern of or about 90 degrees, an axis of the spray pattern may be angled relative to the axis of the nozzle. Likewise, an axis of the cone-shaped area containing little or no spray may be angled relative to the axis of the nozzle. Further, as the discussed above, any desired spray pattern, e.g., other than 90 degrees, may be generated by the configuration of the slots and fingers, as should be understood by those of ordinary skill in the art.

In at least some embodiments, one or more portions of one or more embodiments disclosed herein may be embodied in a nozzle, a method and/or a system.

Unless stated otherwise, terms such as, for example, "comprises," "has," "includes," and all forms thereof, are considered open-ended, so as not to preclude additional elements and/or features.

Also unless stated otherwise, terms such as, for example, "in response to" and "based on" mean "in response at least to" and "based at least on," respectively, so as not to preclude being responsive to and/or based on, more than one thing.

Also, unless stated otherwise, the phrase "A and/or B" means the following combinations: (i) A but not B, (ii) B but not A, and (iii) A and B. It should be recognized that the meaning of any phrase that includes the term "and/or" can be determined based on the above. For example, the phrase "A, B and/or C" means the following combinations: (i) A but not B and not C, (ii) B but not A and not C, (iii) C but not A and not B, (iv) A and B but not C, (v) A and C but not B, (vi) B and C but not A, and (vii) A and B and C. Further combinations using and/or shall be similarly construed.

As may be recognized by those of ordinary skill in the pertinent art based on the teachings herein, numerous changes and modifications may be made to the above-described and other embodiments without departing from the spirit and/or scope of the invention. Accordingly, this detailed description of embodiments is to be taken in an illustrative as opposed to a limiting sense.

What is claimed is:

1. A spray nozzle comprising:

a body having a proximal end and a distal end and defining a fluid passageway to flow fluid in a direction from the proximal end toward the distal end, the body having an outer wall disposed at least partly circumferentially about an axis, the outer wall defining a first plurality of fluid-flow orifices and a second plurality of fluid-flow orifices that are in fluid communication with the fluid passageway, spaced at least partly circumferentially around the outer wall and extending therethrough;

a first deflector disposed at least partly circumferentially about the axis, radially outwardly of the body and coupled thereto, the first deflector being in fluid communication with the first plurality of fluid-flow orifices and defining a first plurality of slots that are spaced circumferentially from each other at least partly circumferentially about the first deflector and extending outwardly and toward the proximal end of the body, the first deflector further defining a first plurality of fingers that are spaced circumferentially from each other at least partly circumferentially about the first deflector and extend outwardly and toward the proximal end of the body, wherein circumferentially successive ones of the first plurality of slots are spaced apart from one another at least in part by a respective one of the first plurality of fingers; and a second deflector disposed at least partly circumferentially about the axis, radially outwardly of the body and coupled thereto, the second deflector being in fluid communication with the second plurality of fluid-flow orifices and defining a second plurality of slots that are spaced circumferentially from each other at least partly circumferentially about the second deflector and extend outwardly and toward the distal end of the body, the second deflector further defining a second plurality of fingers that are spaced circumferentially from each other at least partly circumferentially about the second deflector and extend outwardly and toward the distal end of the body, wherein circumferentially successive ones of the second plurality of slots are spaced apart from one another at least in part by a respective one of the second plurality of fingers.

2. A spray nozzle as defined in claim 1, wherein the first plurality of fluid-flow orifices are substantially disposed in a first plane and wherein the second plurality of fluid-flow orifices are substantially disposed in second plane different than the first plane.

3. A spray nozzle as defined in claim 1, wherein the first plurality of fluid-flow orifices are circumferentially offset from the second plurality of fluid-flow orifices.

4. A spray nozzle as defined in claim 1, wherein the first deflector comprises a first deflector cup and wherein the second deflector comprises a second deflector cup.

5. A spray nozzle as defined in claim 1, wherein configurations of adjacent ones of the first plurality of slots vary from each other, configurations of adjacent ones of the first plurality of fingers vary from each other, configurations of adjacent ones of the second plurality of slots vary from each other, and configurations of adjacent ones of the second plurality of fingers vary from each other.

6. A spray nozzle as defined in claim 1, wherein configurations of the first plurality of slots define a repeating pattern on the first deflector, configurations of the first plurality of fingers define a repeating pattern on the first deflector, configurations of the second plurality of slots define a repeating pattern on the second deflector, and configurations of the second plurality of fingers define a repeating pattern on the second deflector.

7. A spray nozzle as defined in claim 1, wherein the spray nozzle produces a 360 degree omni-directional spray pattern.

8. A spray nozzle as defined in claim 1, wherein the spray nozzle produces about a 270 degree spray pattern.

9. A spray nozzle as defined in claim 1, wherein the spray nozzle is self draining.

10. A spray nozzle as defined in claim 1, wherein the first plurality of fluid-flow orifices and the second plurality of fluid-flow orifices are of minimum dimensions necessary to prevent clogging thereof by debris in fluid passing therethrough.

11. A spray nozzle as defined in claim 1, wherein the first plurality of slots and the second plurality of slots have a minimum width necessary to prevent clogging thereof by debris in fluid passing therethrough.

12. A spray nozzle as defined in claim 1, wherein consecutive ones of the first plurality of fingers are spaced apart by a first spacing and consecutive ones of the second plurality of fingers are spaced apart by a second spacing, and wherein the first spacing and the second spacing are a minimum spacing necessary to prevent clogging thereof by debris in fluid passing therethrough.

13. A spray nozzle as defined in claim 1, wherein the body and the first deflector define a crevice-free juncture or joint and the body and the second deflector define a crevice-free juncture or joint.

14. A spray nozzle as defined in claim 1, wherein (a) a length of at least one of the fingers of the first deflector differs from a length of another of the fingers of the first deflector; (b) a length of at least one of the fingers of the second deflector differs from a length of another of the fingers of the second deflector; (c) a length of at least one of the slots of the first deflector differs from a length of another of the slots of the first deflector; and (d) a length of at least one of the slots of the second deflector differs from a length of another of the slots of the second deflector.

15. A spray nozzle as defined in claim 1, wherein at least one of the slots of the first deflector and/or at least one of the slots of the second deflector does not intersect the outer wall of the body.

16. A spray nozzle comprising:

a body defining a fluid passageway to flow fluid in a direction, the body having an outer wall disposed at least partly circumferentially about an axis, the outer wall defining a plurality of fluid-flow orifices that are in fluid communication with the fluid passageway, spaced at least partly circumferentially around the outer wall and extending therethrough, each one of the plurality of fluid-flow orifices defining a flow direction; and at least one deflector disposed at least partly circumferentially about the axis, outwardly of the body and coupled thereto, the at least one deflector being in fluid communication with the plurality of fluid-flow orifices and defining a concave shape, at least in part, a plurality of slots that are spaced circumferentially from each other at least partly circumferentially about the at least one deflector and extend outwardly relative to the body, and a plurality of fingers that are spaced circumferentially from each other at least partly circumferentially about the at least one deflector and extend outwardly relative to the body, each one of the plurality of fingers and the plurality of slots being in fluid communication with at least one of the plurality of fluid-flow orifices and defining an angle relative to the flow direction defined by said at least one of the plurality of fluid-flow orifices in fluid communication therewith, wherein circumferentially successive ones of the plurality of slots are spaced apart from one another at least in part by a respective one of the plurality of fingers, wherein one or more of (i) said angle defined by one of the plurality of fingers is different than said angle defined by another of the plurality of fingers or (ii) said angle defined by one of the plurality of slots is different than said angle defined by another of the plurality of slots.

17. A spray nozzle as defined in claim 16 wherein the spray nozzle produces at least a 180 degree spray pattern.

18. A spray nozzle as defined in claim 16, wherein the at least one deflector comprises a deflector cup.

19. A spray nozzle as defined in claim 16, wherein configurations of adjacent ones of the plurality of slots vary from each other, and configurations of adjacent ones of the plurality of fingers vary from each other.

20. A spray nozzle as defined in claim 16, wherein configurations of the plurality of slots define a repeating pattern on the at least one deflector, and configurations of the plurality of fingers define a repeating pattern on the at least one deflector.

21. A spray nozzle as defined in claim 16, wherein the plurality of fluid-flow orifices are of minimum dimensions necessary to prevent clogging thereof by debris in fluid passing therethrough.

22. A spray nozzle as defined in claim 16, wherein the plurality of slots have a minimum width necessary to prevent clogging thereof by debris in fluid passing therethrough.

23. A spray nozzle as defined in claim 16, wherein consecutive ones of the plurality of fingers are spaced apart by a spacing that is a minimum spacing necessary, to prevent clogging thereof by debris in fluid passing therethrough.

24. A spray nozzle as defined in claim 16, wherein the spray nozzle is self draining.

25. A spray nozzle as defined in claim 16, wherein the body and the at least one deflector define a crevice-free juncture or joint.

26. A spray nozzle as defined in claim 16, wherein (a) a length of at least one of the fingers differs from a length of another of the fingers; and/or (b) a length of at least one of the slots differs from a length of another of the slots.

27. A spray nozzle as defined in claim 16, wherein at least one of the slots does not intersect the outer wall of the body.

28. A method comprising:

spraying fluid from a spray nozzle comprising a body defining a fluid passageway to flow fluid in a direction, the body having an outer wall disposed at least partly circumferentially about an axis, the outer wall defining a plurality of fluid-flow orifices that are in fluid communication with the fluid passageway, spaced at least partly circumferentially around the outer wall and extending therethrough, each one of the plurality of fluid-flow orifices defining a flow direction; and at least one deflector disposed at least partly circumferentially about the axis, outwardly of the body and coupled thereto, the at least one deflector being in fluid communication with the plurality of fluid-flow orifices and defining a concave shape, at least in part, a plurality of slots that are spaced circumferentially from each other at least partly circumferentially about the at least one deflector and extend outwardly relative to the body, and a plurality of fingers that are spaced circumferentially from each other at least partly circumferentially about the at least one deflector and extend outwardly relative to the body, each one of the plurality of fingers and the plurality of slots being in fluid communication with at least one of the plurality of fluid-flow orifices and defining an angle relative to the flow direction defined by said at least one of the plurality of fluid-flow orifices in fluid communication therewith, wherein circumferentially successive ones of the plurality of slots are spaced apart from one another at least in part by a respective one of the plurality of fingers, wherein one or more of (i) said angle defined by one of the plurality of fingers is different than said angle defined by another of the plurality of fingers or (ii) said angle defined by one of the plurality of slots is different than said angle defined by another of the plurality of slots;

wherein the spraying step includes (i) flowing fluid outwardly from the body in fluid communication with a source of said fluid and over the at least one deflector in an at least partly radial direction relative to the body; and (ii) flowing the fluid off of the at least one deflector at a plurality of said angles defined by said plurality of fingers and said plurality of slots.

29. A method as defined by claim 28, wherein step (ii) includes flowing the fluid off of the at least one deflector in an approximately 180 degree spray pattern.

30. A method as defined in claim 28, wherein step (ii) includes flowing the fluid off of the at least one deflector in a substantially circumstantially symmetrical pattern about the body.

31. A method as defined in claim 28, wherein step (ii) includes flowing the fluid off of the at least one deflector in a circumstantially asymmetrical pattern about the body.

32. A method as defined in claim 28, further including preventing clogging of the plurality of slots by debris in the fluid passing therethrough.

33. A method as defined in claim 28, wherein (a) a length of at least one of the fingers differs from a length of another of the fingers; and/or (b) a length of at least one of the slots differs from a length of another of the slots.

34. A method as defined in claim 28, wherein at least one of the slots does not intersect the outer wall of the body.

35. A method comprising:

spraying fluid from a spray nozzle comprising a body having a proximal end and a distal end and defining a fluid passageway to flow fluid in a direction from the proximal end toward the distal end, the body having an outer wall disposed at least partly circumferentially about an axis, the outer wall defining a first plurality of fluid-flow orifices and a second plurality of fluid-flow orifices that are in fluid communication with the fluid passageway, spaced at least partly circumferentially around the outer wall and extending therethrough;

a first deflector disposed at least partly circumferentially about the axis, radially outwardly of the body and coupled thereto, the first deflector being in fluid communication with the first plurality of fluid-flow orifices and defining a first plurality of slots that are spaced circumferentially from each other at least partly circumferentially about the first deflector and extending outwardly and toward the proximal end of the body, the first deflector further defining a first plurality of fingers that are spaced circumferentially from each other at least partly circumferentially about the first deflector and extend outwardly and toward the proximal end of the body, wherein circumferentially successive ones of the first plurality of slots are spaced apart from one another at least in part by a respective one of the first plurality of fingers; and a second deflector disposed at least partly circumferentially about the axis, radially outwardly of the body and coupled thereto, the second deflector being in fluid communication with the second plurality of fluid-flow orifices and defining a second plurality of slots that are spaced circumferentially from each other at least partly circumferentially about the second deflector and extend outwardly and toward the distal end of the body, the second deflector further defining a second plurality of fingers that are spaced circumferentially from each other at least partly circumferentially about the second deflector and extend outwardly and toward the distal end of the body, wherein circumferentially successive ones of the second plurality of slots are spaced apart from one another at least in part by a respective one of the second plurality of fingers;

wherein the spraying step includes (i) flowing fluid outwardly from the body in fluid communication with a source of said fluid and over the first and second deflectors in an at least partly radial direction relative to the body; and (ii) flowing the fluid off of the first and second deflectors by flowing the fluid through the plurality of slots of the first and second deflectors and off ends of the plurality of fingers of the first and second deflectors.

36. A method as defined in claim 35, wherein step (i) includes flowing a portion of said fluid over the first deflector at a first location of the body and flowing a portion of said fluid over the second deflector at a second location of the body.

37. A method as defined in claim 35, wherein step (ii) includes flowing the fluid off of the first and second deflectors in a substantially 360 degree spray pattern.

38. A method as defined in claim 35, wherein step (ii) includes flowing the fluid off of the first and second deflectors in a substantially 360 degree omni-directional spray pattern.

39. A method as defined in claim 35, wherein step (ii) includes flowing the fluid off the first and second deflectors in an approximately 270 degree spray pattern.

40. A method as defined in claim 35, wherein step (ii) includes flowing the fluid off of the first and second deflectors in a substantially circumstantially symmetrical pattern about the body.

41. A method as defined in claim 35, wherein step (ii) includes flowing the fluid off of the first and second deflectors in a circumstantially asymmetrical pattern about the body.

42. A method as defined in claim 35, further including preventing clogging of the plurality of slots of the first and second deflectors by debris in the fluid passing therethrough.

43. A method as defined in claim 35, wherein (a) a length of at least one of the fingers of the first deflector differs from a length of another of the fingers of the first deflector; (b) a length of at least one of the fingers of the second deflector differs from a length of another of the fingers of the second deflector; (c) a length of at least one of the slots of the first deflector differs from a length of another of the slots of the first deflector; and (d) a length of at least one of the slots of the second deflector differs from a length of another of the slots of the second deflector.

44. A method as defined in claim 35, wherein at least one of the slots of the first deflector and/or at least one of the slots of the second deflector does not intersect the outer wall of the body.

* * * * *